US007128058B2

(12) United States Patent
Yamamoto

(10) Patent No.: US 7,128,058 B2
(45) Date of Patent: Oct. 31, 2006

(54) FUEL INJECTION SYSTEM FOR INTERNAL COMBUSTION ENGINE

(75) Inventor: Yoshihisa Yamamoto, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/224,098

(22) Filed: Sep. 13, 2005

(65) Prior Publication Data

US 2006/0065241 A1 Mar. 30, 2006

(30) Foreign Application Priority Data

Sep. 27, 2004 (JP) ..... 2004-279494

(51) Int. Cl.
*F02M 37/04* (2006.01)
*F02M 69/46* (2006.01)

(52) U.S. Cl. ..... 123/495; 123/456

(58) Field of Classification Search ..... 123/446, 123/456, 495, 447; 417/225, 226, 227
See application file for complete search history.

(56) References Cited

U.S. PATENT DOCUMENTS 5,622,152 A 4/1997 Ishida
6,453,875 B1 * 9/2002 Mahr et al. ..... 123/446
2005/0077378 A1 * 4/2005 Kropp et al. ..... 239/88
2005/0172935 A1 * 8/2005 Magel et al. ..... 123/446
2006/0042597 A1 * 3/2006 Magel ..... 123/446

FOREIGN PATENT DOCUMENTS

JP 2003-106235 4/2003

* cited by examiner

*Primary Examiner*—Mahmoud Gimie
(74) *Attorney, Agent, or Firm*—Nixon & Vanderhye PC

(57) ABSTRACT

A control valve is constructed as a two-position three-way valve. A switching port of the control valve and a control chamber of a pressure intensifier are connected to the control valve through a reciprocation passage. Fuel pressure in the control chamber is controlled by the control valve. The reciprocation passage is formed of two fuel passages for connecting the switching port of the control valve with the control chamber in parallel. One fuel passage is provided with a check valve for preventing fuel from flowing from the control chamber to the control valve and the other fuel passage is provided with a hydraulic valve for preventing the fuel from flowing from the control valve to the control chamber and a restrictor.

17 Claims, 10 Drawing Sheets

X
Y
Z

DRIVING SIGNAL

BACK PRESSURE RELEASING PORT

BACK PRESSURE APPLYING PORT

PRESSURE INCREASING PORT

LIFT

INJECTION RATE

FUEL INJECTION SYSTEM FOR INTERNAL COMBUSTION ENGINE

CROSS-REFERENCE TO RELATED APPLICATION

This application is based on Japanese Patent Application No. 2004-279494 filed on Sep. 27, 2004, the disclosure of which is incorporated herein by reference.

FIELD OF THE INVENTION

The present invention relates to a fuel injection system for an internal combustion engine, in particular, for a diesel engine.

BACKGROUND OF THE INVENTION

A common rail system is known as a fuel injection system for an internal combustion engine. This common rail system is a system that includes an accumulator (common rail) for accumulating fuel in the state of a specified pressure and injects high-pressure fuel supplied by the accumulator into the cylinder of the internal combustion engine by an injector and has excellent performance of controlling an injection pressure and an injection quantity independently. In recent years, from the viewpoint of cleaning exhaust gas and decreasing fuel consumption, there has been a growing demand that such a common rail should be further enhanced in performance and an injection pressure needs to be increased. A publicly known technology capable of realizing this easily is proposed in U.S. Pat. No. 5,622,152.

A fuel injection system described in the patent document 1 has "a mechanism for hydraulically controlling an operation of opening and closing of an injection nozzle", which is an advantage of the common rail, and a pressure intensifying mechanism for intensifying the pressure of fuel in the accumulator. With this pressure increasing mechanism, it is possible not only to inject the fuel at high pressure but also to control both of pressure intensification and injection. As a result, it is possible to change the injection pressure in one injection cycle and to realize small injection at low pressure and main injection at extremely high pressure. Moreover, the pattern of injection rate can be optimized and hence finer combustion can be optimized.

However, in the '152 patent, essentially, it is necessary to control two operations, that is, a pressure intensifying operation and an injecting operation independently from each other. Hence, there is presented a problem that the technology needs at least two actuators and hence makes the construction of the system complex and increases cost.

In contrast to this, another system, described in JP 2003-106235A. is capable of more easily realizing the same function as is provided by the '152 patent.

FIG. 10 is a hydraulic circuit diagram of a fuel injection system described in the patent document 2.

This fuel injection system includes one control valve 100 driven by an actuator, a first fuel passage 120 for connecting this control valve 100 and a control chamber 111 of a pressure intensifier 110, a second fuel passage 140 for connecting the control valve 100 and a backpressure chamber 131 of an injection nozzle 130, and a third fuel passage 160 for connecting an accumulator 150 and the control chamber 111 of the pressure intensifier 110, and the fuel passages 120, 140, and 160 are provided with restrictors 170, 180, and 190, respectively.

The control valve 100 has a hydraulic port 101 to which the first fuel passage 120 and the second fuel passage 140 are connected in common and a low pressure port 102 connecting with a low pressure side and a valve body 103 is driven between a valve closing position (state shown in FIG. 10) where the hydraulic port 101 is disconnected from the low pressure port 102 and a valve opening position where the hydraulic port 101 is connected to the low pressure port 102.

When the valve body 103 is driven to the valve closing position, the fuel pressure in the accumulator 150 is supplied to the control chamber 111 of the pressure intensifier 110 and the backpressure chamber 131 of the injection nozzle 130. At this time, in the pressure intensifier 110, the hydraulic pressures on both upper and lower sides of a hydraulic piston 112 balance with each other, so that the pressure of fuel supplied from the accumulator 150 to a pressurizing chamber 113 is not intensified. Moreover, in the injection nozzle 130, a needle (not shown) receives fuel pressure in the backpressure chamber 131 to keep a state where a valve is closed and hence the fuel is not injected.

Next, when the valve body 103 is driven to a valve opening position, the hydraulic port 101 and the low pressure port 102 of the control valve 100 are connected to each other to release the fuel pressure in the control chamber 111 and the backpressure chamber 131 via the control valve 100 to a low pressure side. With this, in the pressure intensifier 110, the hydraulic pressures on both upper and lower sides of the hydraulic piston 112 are thrown out of balance to move the hydraulic piston 112 downward in the drawing, whereby the fuel in the pressurizing chamber 113 is pressurized and is supplied to the injection nozzle 130. Moreover, in the injection nozzle 130, the fuel pressure in the backpressure chamber 131 is decreased to lift the needle, whereby the fuel of extremely high pressure, which is supplied from the pressure intensifier 110, is injected.

However, in a fuel injection system described in the patent document 2, the control chamber 111 of the pressure intensifier 110 and the backpressure chamber 131 of the injection nozzle 130 are always connected to the accumulator 150. In other words, the control chamber 111 of the pressure intensifier 110 and the backpressure chamber 131 of the injection nozzle 130 always communicate with the accumulator 150 irrespective of a state where the control valve 100 is opened or closed. For this reason, although the restrictors 170 to 190 are provided in the respective fuel passages 120, 140, and 160, even if these three restrictors 170 to 190 are used, the values of the respective restrictors 170 to 190 have effects on each other to make it difficult to optimally control the action of the pressure intensifier 110 and the action of the injection nozzle 130.

Moreover, when the control valve 100 is opened, the fuel pressure in the accumulator 150 is released to the low pressure side via the control valve 100 to bring about a state where the fuel freely flows out of the accumulator 150 to cause an energy loss, which results in reducing the fuel consumption of the internal combustion engine.

SUMMARY OF THE INVENTION

The present invention has been made on the basis of the above circumstances. The object of the present invention is to provide such a fuel injection system for an internal combustion engine that can control a pressure intensifying action and an injection action by a control valve using two-position actuator and can prevent a degree of flexibility in control from being reduced when one actuator is provided and can prevent fuel from being freely flowed out of an accumulator when fuel pressure in the control chamber of a pressure intensifier is released to a low pressure side.

A fuel injection system for an internal combustion engine of the present invention is characterized by including: a hydraulic pressure supply passage that supplies fuel pressure in an accumulator to the control chamber of a pressure intensifier and the backpressure chamber of an injection nozzle; a hydraulic pressure release passage that releases fuel pressure in the control chamber and the backpressure chamber to a low pressure side; and two fuel passages that connect a control valve to the control chamber of the pressure intensifier in parallel, one fuel passage being provided with a first flow direction control means for preventing the fuel from flowing from the control chamber to the control valve to form a portion of the hydraulic pressure supply passage, the other fuel passage being provided with a second flow direction control means for preventing the fuel from flowing from the control valve to the control chamber to form a portion of the hydraulic pressure release passage.

According to the above configuration, the one fuel passage for supplying the fuel pressure in the accumulator to the control chamber of the pressure intensifier and the other fuel passage for releasing the fuel pressure in the control chamber to a low pressure side are provided separately from each other, so that a pressuring (pressure intensifying) action and a return action of the pressure intensifier can be adjusted independently of each other. That is, it is possible to adjust the pressure intensifying speed of the pressure intensifier by a pressure release speed when the fuel pressure in the control chamber is released to the low pressure side and it is possible to adjust the return speed of the pressure intensifier by a pressure supply speed when the fuel pressure in the accumulator is supplied to the control chamber of the pressure intensifier.

Moreover, since the hydraulic pressure supply passage and the hydraulic pressure release passage are selectively opened and closed by the control valve, the accumulator and the control chamber of the pressure intensifier are not always connected to each other through the hydraulic pressure supply passage. In other words, when the control valve opens the hydraulic pressure release passage, the fuel pressure in the control chamber is released to the low pressure side through the hydraulic pressure supply passage. However, at this time, the control valve closes the hydraulic pressure supply passage and hence the fuel pressure in the accumulator is never released to the low pressure side via the control valve. With this, even if the fuel pressure in the control chamber is released to the low pressure side, the fuel is not flowed freely from the accumulator to the low pressure side and an energy loss can be prevented and hence a reduction in the fuel consumption of the internal combustion engine can be prevented.

DESCRIPTION OF THE PREFERRED EMBODIMENTS

The best mode for carrying out the present invention will be described in detail by the following embodiments.

[First Embodiment]

Figure 1:
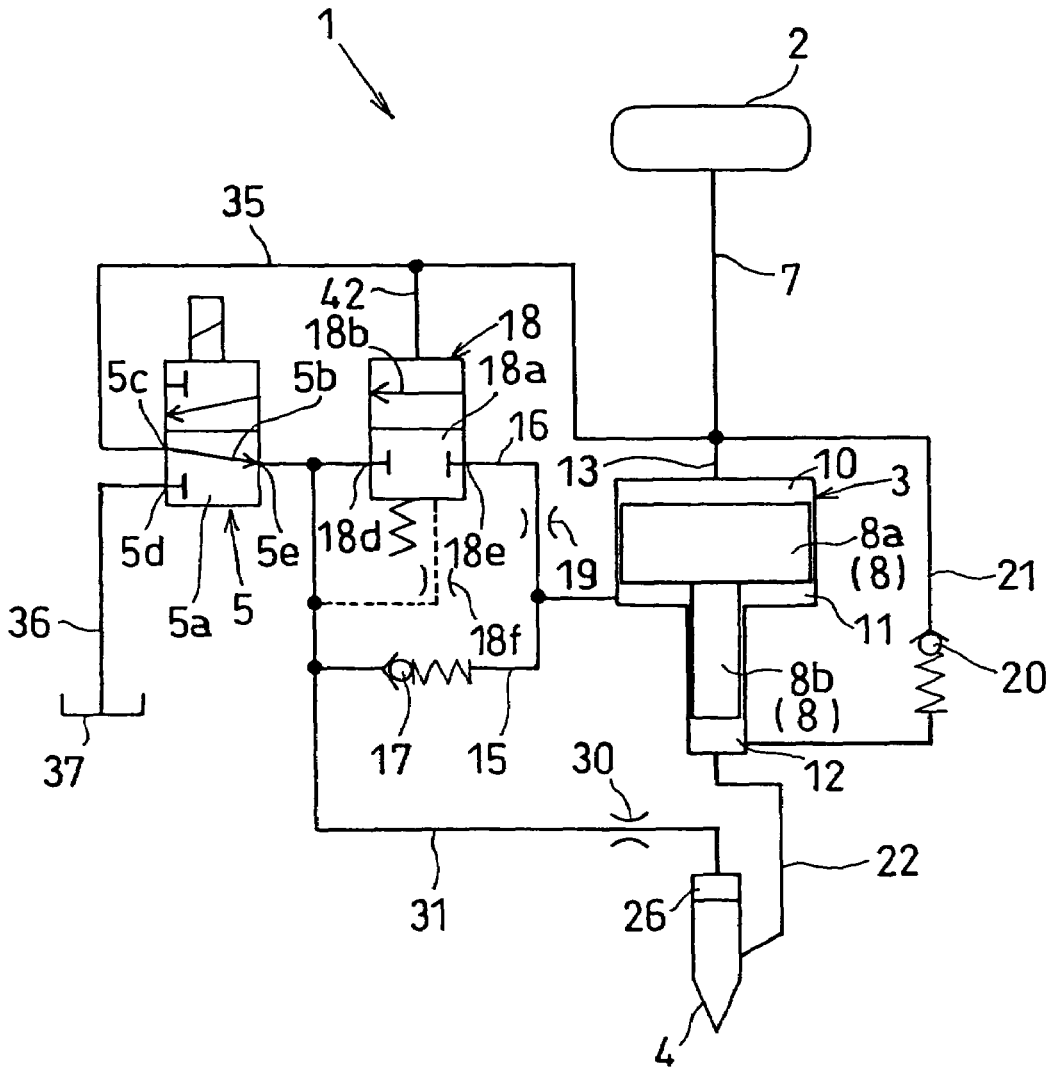
FIG. 1 is a hydraulic circuit diagram of a fuel injection system according to a first embodiment.
Figure 2:
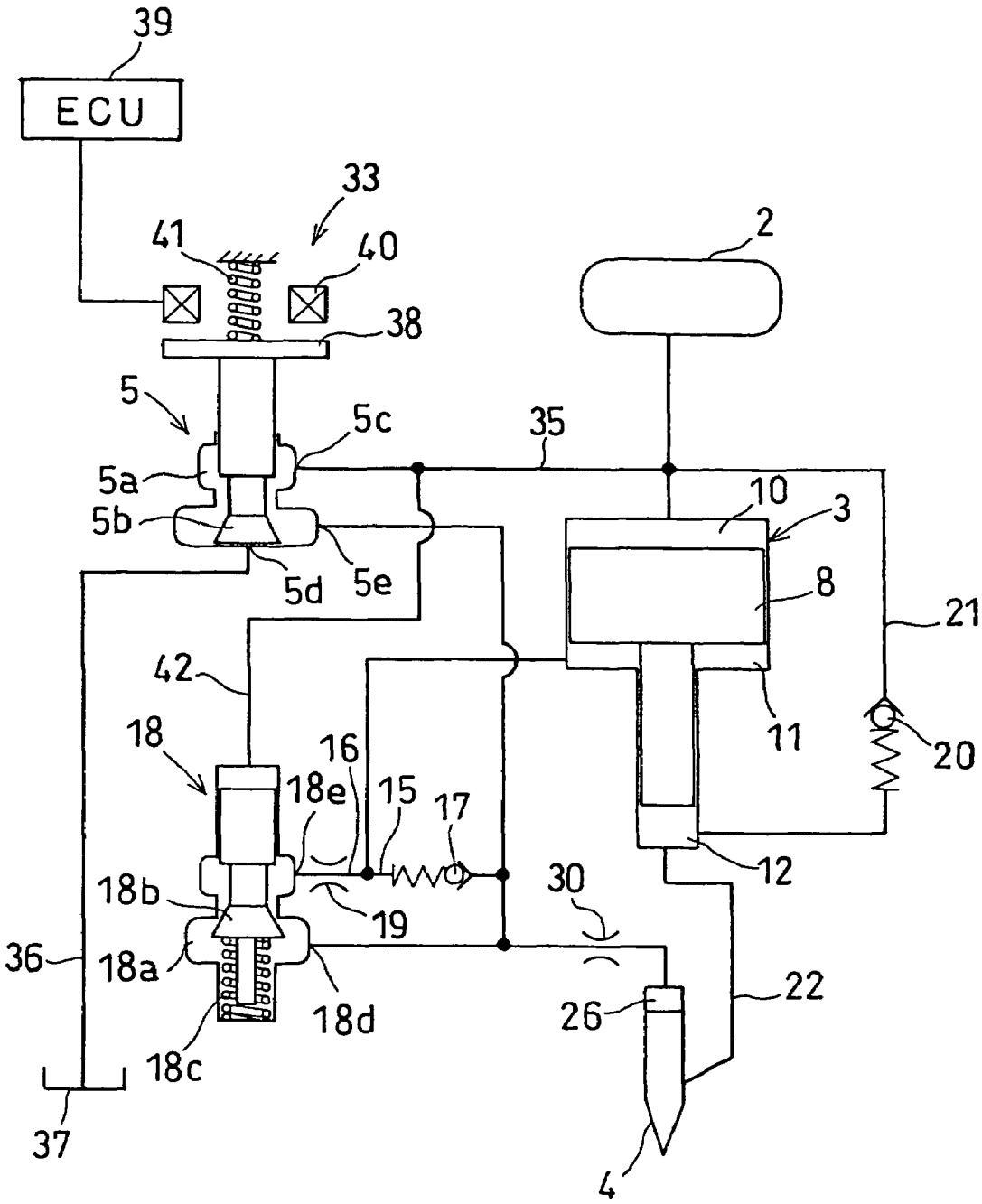
FIG. 2 is a hydraulic circuit diagram including the specific configurations of a control valve and a hydraulic valve used for the fuel injection system according to a first embodiment.
Figure 3:
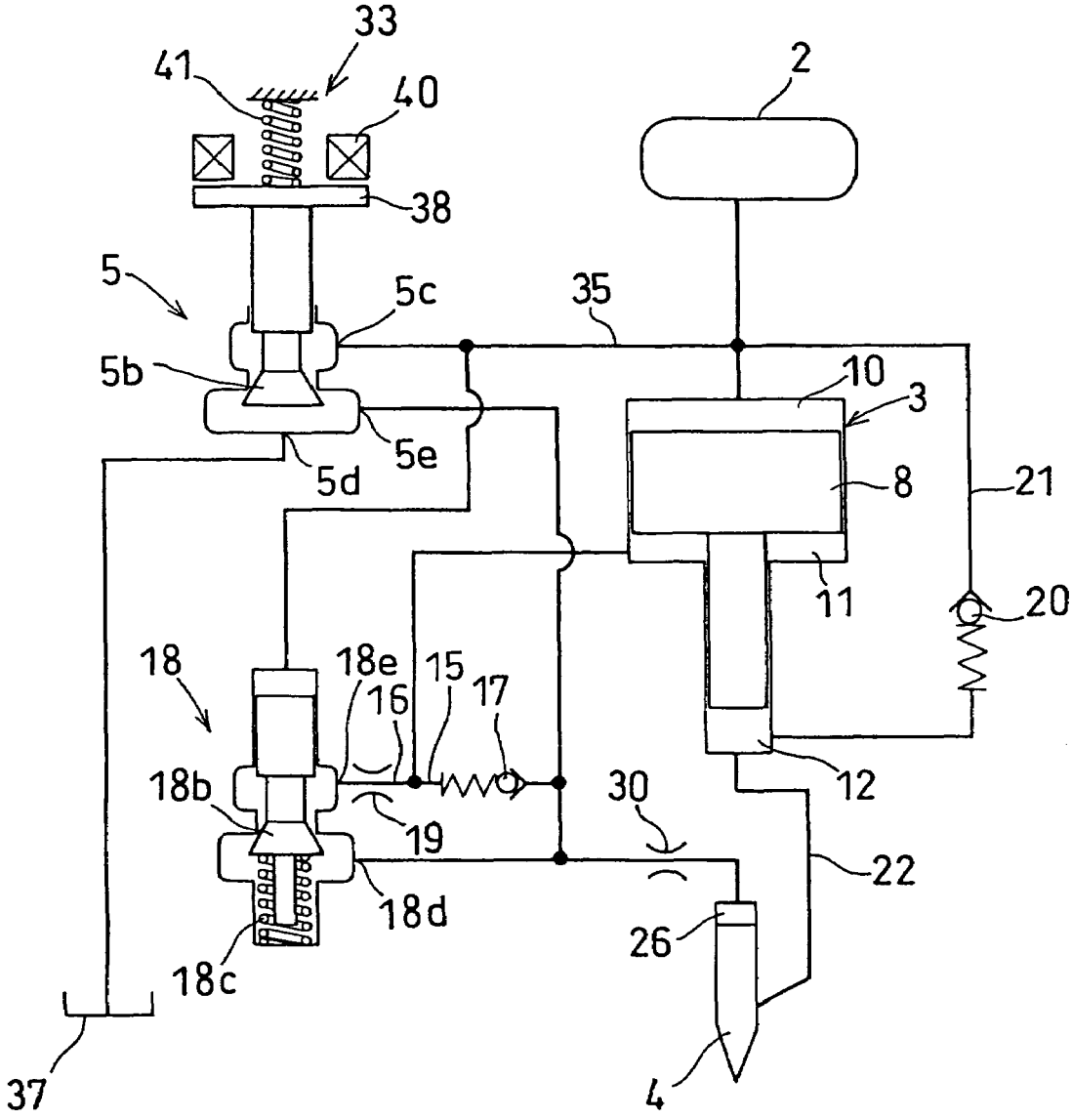
FIG. 3 is a diagram showing the action of the fuel injection system according to a first embodiment.
Figure 4:
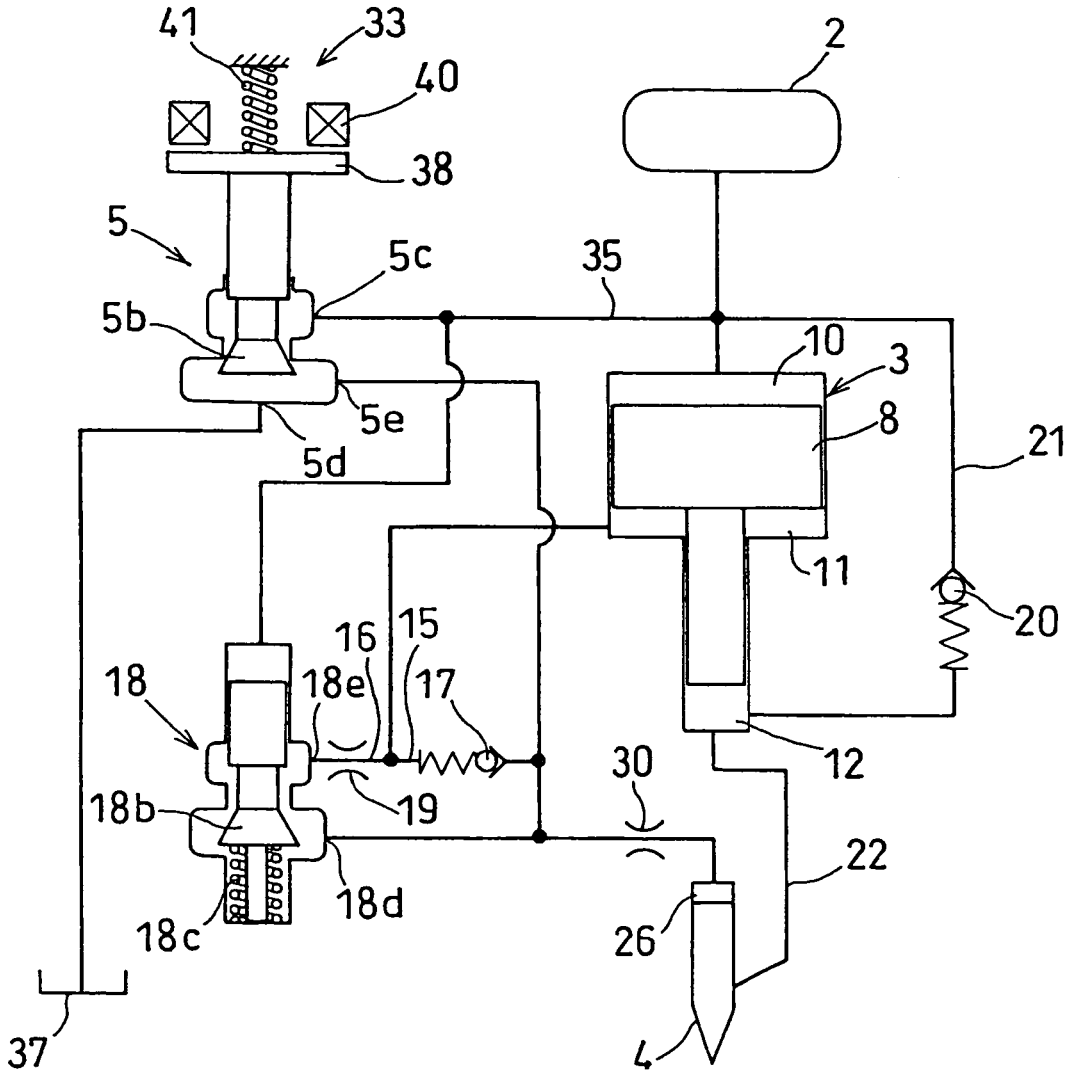
FIG. 4 is a diagram showing the action of the fuel injection system according to a first embodiment.

FIG. 1 is a hydraulic circuit diagram of a fuel injection system in accordance with the first embodiment. FIGS. 2 to 4 are hydraulic circuit diagrams including the specific constructions of a control valve and a hydraulic valve used for the fuel injection system.

A fuel injection system 1 of the present invention is applied, for example, to the common rail system of a diesel engine for a vehicle. The fuel injection system 1, as shown in FIG. 2, includes an accumulator 2 for accumulating fuel in the state of a predetermined pressure, a pressure intensifier 3 for intensifying the pressure of fuel supplied from the accumulator 2, an injection nozzle 4 for injecting the fuel supplied from the accumulator 2 or the fuel having its pressure intensified by the pressure intensifier 3, a control valve 5 for controlling the action of the pressure intensifier 3 and the action of the injection nozzle 4, and the like. Here, parts except for the accumulator 2, that is, the pressure intensifier 3, the injection nozzle 4, the control valve 5, and the like, as shown in FIG. 5, are integrally combined with each other, thereby being constructed as one fuel injection valve 6.

The accumulator 2 is connected to the fuel injection valve 6 by a fuel pipe 7 and the fuel accumulated in the accumulator 2 is supplied through the fuel pipe 7 to the fuel injection valve 6.

Figure 5:
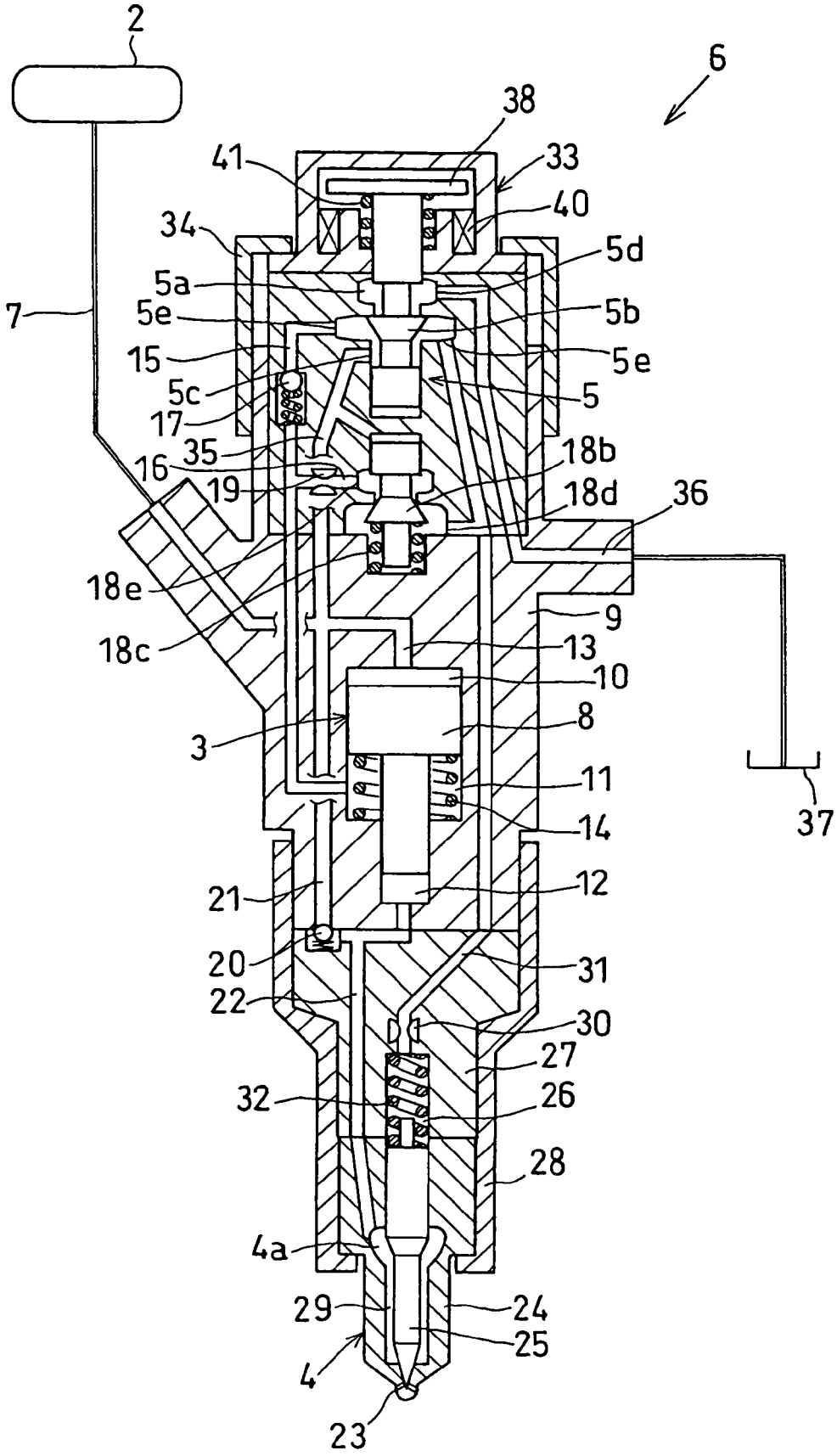
FIG. 5 is a general sectional view showing the structure of the fuel injection valve according to a first embodiment.

The pressure intensifier 3 includes a hydraulic piston 8 having a large-diameter piston 8*a* and a small-diameter plunger 8*b* provided at concentric positions and this hydraulic piston 8 is slidably received in a larger-diameter bore and a small-diameter bore formed in a body 9 (refer to FIG. 5). In the large-diameter bore in which the large-diameter piston 8*a* is received, a driving chamber 10 is formed on the upper side above the top end surface of the large-diameter piston 8*a* and a control chamber 11 is formed on the lower side below the bottom end surface of the large-diameter piston 8*a*. On the other hand, in the small-diameter bore in which the small-diameter plunger 8*b* is received, a pressurizing chamber 12 is formed on the lower side below the bottom end surface of the small-diameter plunger 8*b*.

The driving chamber 10 is connected to the fuel pipe 7 via a fuel passage 13 and the fuel pressure in the accumulator 2 is supplied through the fuel pipe 7 and the fuel passage 13. The fuel pressure in the driving chamber 10 is applied to the top end surface of the hydraulic piston 8 to urge the hydraulic piston 8 downward.

The control chamber 11 is connected to the control valve 5 through a reciprocation passage, which will be described later, and the fuel pressure in the control chamber 11 is controlled by the control valve 5. Here, as shown in FIG. 5, a spring 14 for urging the hydraulic piston 8 upward in the drawing is arranged in the control chamber 11.

The reciprocation passage, as shown in FIG. 1 and FIG. 2, is formed of two fuel passages 15, 16 for connecting the control valve 5 and the control chamber 11 in parallel. One fuel passage 15 is provided with a check valve 17 for preventing the fuel from flowing from the control chamber 11 to the control valve 5 and the other fuel passage 16 is provided with a check valve 18 for preventing the fuel from flowing from the control valve 5 to the control chamber 11 and a restrictor 19.

A pressurizing chamber 12 is connected to the fuel pipe 7 through a fuel passage 21 having a check valve 20 and communicates through a fuel passage 22 with an oil reservoir 4*a* (refer to FIG. 5) formed in the injection nozzle 4. The check valve 20 allows the fuel (supplied from the accumulator 2) in the fuel passage 21 to flow toward the pressurizing chamber 12 and prevents the fuel from flowing in an opposite direction (flowing toward the accumulator 2). With this, the fuel pressure in the accumulator 2 is supplied to the pressurizing chamber 12 and is further supplied through the fuel passage 22 also to the oil reservoir 4*a* of the injection nozzle 4.

The injection nozzle 4, as shown in FIG. 5, is constructed of a nozzle body 24 having an injection hole 23 formed in a tip, a needle 25 received in this nozzle body 24, a nozzle holder 27 forming a backpressure chamber 26 in the upper portion in the drawing of this needle 25, and the like. The injection nozzle 4 is arranged below the body 9 and is fixed to the body 9 by a retainer 28.

An annular fuel passage 29 is formed around the needle 25 in the nozzle body 24 and the oil reservoir 4*a* is formed at the upstream end of this fuel passage 29. Moreover, a conical seat surface (not shown) is formed between the fuel passage 29 and the injection hole 23.

The backpressure chamber 26 is connected to the control valve 5 through a fuel passage 31 having a restrictor 30 and the fuel pressure in the backpressure chamber 26 is controlled by this control valve 5.

When the fuel pressure in the accumulator 2 is supplied to the backpressure chamber 26, the needle 25 receives the fuel pressure in the accumulator 2 and the urging force of a spring 32 (refer to FIG. 5) arranged in the backpressure chamber 26 and is thereby pressed in the direction of closing the valve (downward in FIG. 5), whereby a seat line (not shown) formed at the tip portion of the needle 25 is seated on the seat surface to disconnect the fuel passage 29 from the injection hole 23. On the other hand, when the fuel pressure in the backpressure chamber 26 is released by the control valve 5, the needle 25 is lifted to connect the fuel passage 29 to the injection hole 23, whereby the fuel supplied from the oil reservoir 4*a* is flowed through the fuel passage 29 and is injected from the injection hole 23.

The control valve 5 has a valve chamber 5*a*, a valve body 5*b* received in this valve chamber 5*a*, and a two-position actuator 33 for driving this valve body 5*b*. The control valve 5 is arranged on the top of the body 9 and is fixed to the body 9 by a retainer 34.

In the valve chamber 5*a*, as shown in FIG. 5, are formed an input port 5*c* to which the fuel pressure in the accumulator 2 is supplied through a fuel passage 35, a low pressure port 5*d* communicating with a fuel tank 37 through a drain passage 36, a switching port 5*e* connected to the control chamber 11 of the pressure intensifier 3 through the above-described reciprocation passage, and a switching port 5*e* connected to the backpressure chamber 26 of the injection nozzle 4 through the fuel passage. Hereafter, description will be provided with the two switching port 5*e* assumed as common switching ports 5*e*.

The valve body 5*b* moves between an input position where the low pressure port 5*d* is disconnected from the switching port 5*e* and where the input port 5*c* is connected to the switching port 5*e* (position shown in FIG. 1, FIG. 2, and FIG. 5) and an open position where the input port 5*c* is disconnected from the switching port 5*e* and where the low pressure port 5*d* is connected to the switching port 5*e* (position shown in FIG. 3 and FIG. 4). That is, this control valve 5 is constructed as a two-position three-way valve.

An actuator 33, as shown in FIG. 2, is constructed of a disk-shaped armature 38 coupled to the valve body 5*b*, an electromagnetic coil 40 having its current controlled by an ECU 39, a return spring 41 for urging the armature 38 downward in the drawing, and the like. In this actuator 33, when a current is passed through the electromagnetic coil 40 to generate a magnetic force, the armature has the magnetic force applied thereto and is thereby attracted to be moved upward in the drawing against the reactive force of the return spring 41 to generate a driving force. Moreover, when the passing of the current through the electromagnetic coil 40 is stopped, the magnetic force is destroyed and hence the armature 38 is pushed back by the reactive force of the return spring 41, thereby being returned to an initial state shown in FIG. 2. Here, in the hydraulic circuit diagram shown in FIG. 2, the direction in which the armature 38 is moved is shown in the direction opposite to that in FIG. 5. In other words, in FIG. 5, when the current is passed through the electromagnetic coil 40, the armature 38 receives the electromagnetic force and moves downward in the drawing, but in FIG. 2, the armature 38 is shown in such a way as to move upward in the drawing.

The above-described hydraulic valve 18 is constructed of a valve chamber 18*a*, a valve body 18*b* received in this valve chamber 18*a*, a spring 18*c* for urging this valve body 18*b*, and the like.

In the valve chamber 18*a* are formed the first port 18*d* communicating with the switching port 5*e* of the control valve 5 and the second port 18*e* communicating with the control chamber 11 of the pressure intensifier 3.

The valve body 18*b* moves between a valve closing position (position shown in FIG. 2, FIG. 3, and FIG. 5) where the first port 18*d* is disconnected from the second port 18*e* and a valve opening position (position shown in FIG. 4) where the first port 18*d* is connected to the second port 18*e* and is urged in a direction to close the valve by the spring 18*c* (upward in FIG. 2).

The fuel pressure in the accumulator 2 is always introduced as a bypass (pressure) into this hydraulic valve 18 through a branch passage 42 connected to the fuel passage 35 and is applied to the top end surface of the valve body 18*b* to urge the valve body 18*b* in a direction to open the valve (downward in FIG. 2). On the other hand, the reactive force of the spring 18*c* and the fuel pressure introduced into the first port 18*d* (fuel pressure in the switching port 5*e*) are applied to the bottom end surface of the valve body 18*b*. For this reason, when the fuel pressure introduced into the first port 18*d* becomes equal to the fuel pressure in the accumulator 2, the valve body 18*b* is driven to the valve closing position by the reactive force of the spring 18*c*, and when the fuel pressure introduced into the first port 18*d* is released to the low pressure side, the valve body 18*b* is driven to the valve opening position against the reactive force of the spring 18*c*. That is, this hydraulic valve 18 is constructed as a two-position two-way valve.

Next, the action of the fuel injection system 1 will be described on the basis of a time chart shown in FIG. 2 to FIG. 4 and FIGS. 6A to 6F. Here, X, Y, and Z in FIG. 6A to FIG. 6F correspond to states shown in FIG. 2, FIG. 3, and FIG. 4.

When the electromagnetic coil 40 of the actuator 33 is in an OFF state, as shown in FIG. 2, the valve body 5*b* of the control valve 5 is urged by the return spring 41, thereby being driven to an input position. In this state, in the control valve 5, the switching port 5*e* is disconnected from the low pressure port 5*d* and the input port 5*c* is connected to the switching port 5*e*, so that the accumulator 2 is connected to the backpressure chamber 26 of the injection nozzle 4 to supply the fuel pressure in the accumulator 2 to the backpressure chamber 26.

At this time, in the hydraulic valve 18, the fuel pressure in the accumulator 2 is equally applied to both end surfaces of the valve body 18*b* and hence the valve body 18*b* is urged by the spring 18*c*, thereby being moved to the valve closing position. With this, the other fuel passage 16 is shut by the hydraulic valve 18 and hence the fuel pressure in the accumulator 2 is supplied through one fuel passage 15 also to the control chamber 11 of the pressure intensifier 3.

Moreover, in the pressure intensifier 3, the fuel pressure in the accumulator 2 is supplied also to the driving chamber 10 and the pressurizing chamber 12 and hence the fuel pressures applied to the top and bottom surfaces of the hydraulic piston 8 are brought into balance. As a result, the hydraulic piston 8 is urged by the spring 14 (refer to FIG. 5), thereby being moved upward in the drawing, and as the volume of the pressurizing chamber 12 is extended, the pressurizing chamber 12 is filled with the fuel. In this state, the fuel pressure in the backpressure chamber 26 of the injection nozzle 4 is equal to that in the accumulator 2 and hence the needle 25 is not lifted to disconnect the fuel passage 29 from the injection hole 23 to prevent the fuel from being injected.

Next, when a driving signal (refer to FIG. 6A) is outputted to the actuator 33 by the ECU 39 to pass a current through the electromagnetic coil 40 to generate an attractive force, the valve body 5*b* is moved from the input position shown in FIG. 2 to a release position shown in FIG. 3 against the urging force of the return spring 41. As a result, the input port 5*c* is disconnected from the switching port 5*e* and the switching port 5*e* is connected to the low pressure port 5*d* (refer to FIGS. 6B and 6C). With this, the backpressure chamber 26 of the injection nozzle 4 is connected to the low pressure side to release the fuel pressure of the backpressure chamber 26 to lift the needle 25, whereby the fuel supplied to the oil reservoir 4*a* is injected from the injection hole 23.

At this time, in the hydraulic valve 18, the valve body 18*b* remains at the valve closing position until the fuel pressure in the backpressure chamber 26 is reduced to a predetermined pressure. Hence, the hydraulic piston 8 is never moved the instant when the fuel pressure in the backpressure chamber 26 is released. Therefore, an injection pressure at this time is not equal to an extremely high pressure intensified by the pressure intensifier 3 but is nearly equal to the fuel pressure in the accumulator 2.

Figures 6A, 6B, 6C, 6D, 6E, 6F:
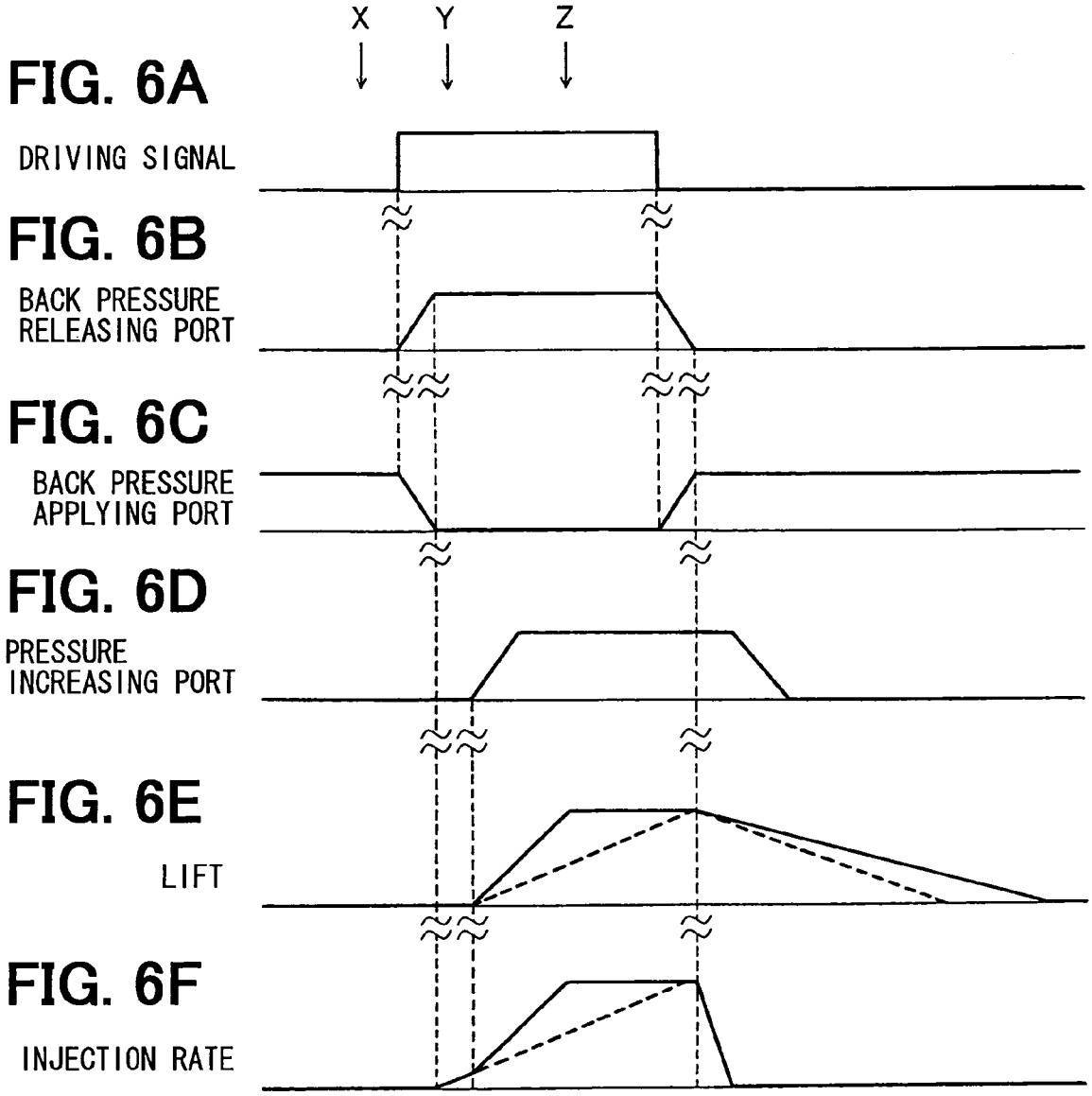
FIGS. 6A to 6F are time charts relating to the action of the fuel injection system according to a first embodiment.

When the fuel pressure in the backpressure chamber 26 is further released to be reduced to a predetermined pressure, the valve body 18*b* of the hydraulic valve 18 is moved from the valve closing position shown in FIG. 3 to the valve opening position shown in FIG. 4 (refer to FIG. 6D). In this state, the control chamber 11 of the pressure intensifier 3 is connected to the switching port 5*e* of the control valve 5 via the hydraulic valve 18, whereby the fuel pressure in the control chamber 11 is released to the low pressure side. As a result, the pressures applied to the top and bottom of the hydraulic piston 8 are thrown out of balance and hence the hydraulic piston 8 is pressed by the fuel pressure in the driving chamber 10, thereby being pressed down (refer to FIG. 6E). With this movement of the hydraulic piston 8, the fuel pressure in the pressurizing chamber 12 starts to rise and finally is pressurized according to the cross-sectional area ratio between the large-diameter piston 8*a* and the small-diameter plunger 8*b*. For example, in the case where the fuel pressure in the accumulator 2 is 50 MPa and where the cross-sectional area ratio between the large-diameter piston 8*a* and the small-diameter plunger 8*b* is set at 4:1, the fuel pressure in the pressurizing chamber 12 becomes 4×50 MPa=200 MPa.

With this, the fuel intensified to an extremely high pressure by the pressure intensifier 3 is injected from the injection nozzle 4 (refer to FIG. 6F).

Thereafter, when the quantity of injection of the fuel becomes a predetermined quantity, the passing of current through the electromagnetic coil 40 is stopped and hence the control valve 5 is returned to an initial state shown in FIG. 2 (the valve body 5*b* is returned to the input position). With this, the fuel pressure in the accumulator 2 is again supplied to the backpressure chamber 26 of the injection nozzle 4 to push back the needle 25, whereby the fuel injection is finished. At this time, although the hydraulic valve 18 is also closed (the valve body 18*b* is moved to the valve closing position), irrespective of the hydraulic valve 18, the fuel pressure in the accumulator 2 is supplied through one fuel passage 15 to the control chamber 11 of the pressure intensifier 3. With this, in the pressure intensifier 3, the hydraulic piston 8 can immediately stop the pressure intensifying action and start a return stroke.

For example, when a fine injection such as a pilot injection is performed before the main injection, the passing of current through the electromagnetic coil 40 is stopped before the hydraulic valve 18 is opened (before the valve body 18*b* is moved to the valve opening position) to return the state shown in FIG. 3 to the state shown in FIG. 2. With this, it is possible to inject the fuel at a low pressure (at the fuel pressure in the accumulator 2) before the pressure becomes intensified.

Figure 7:
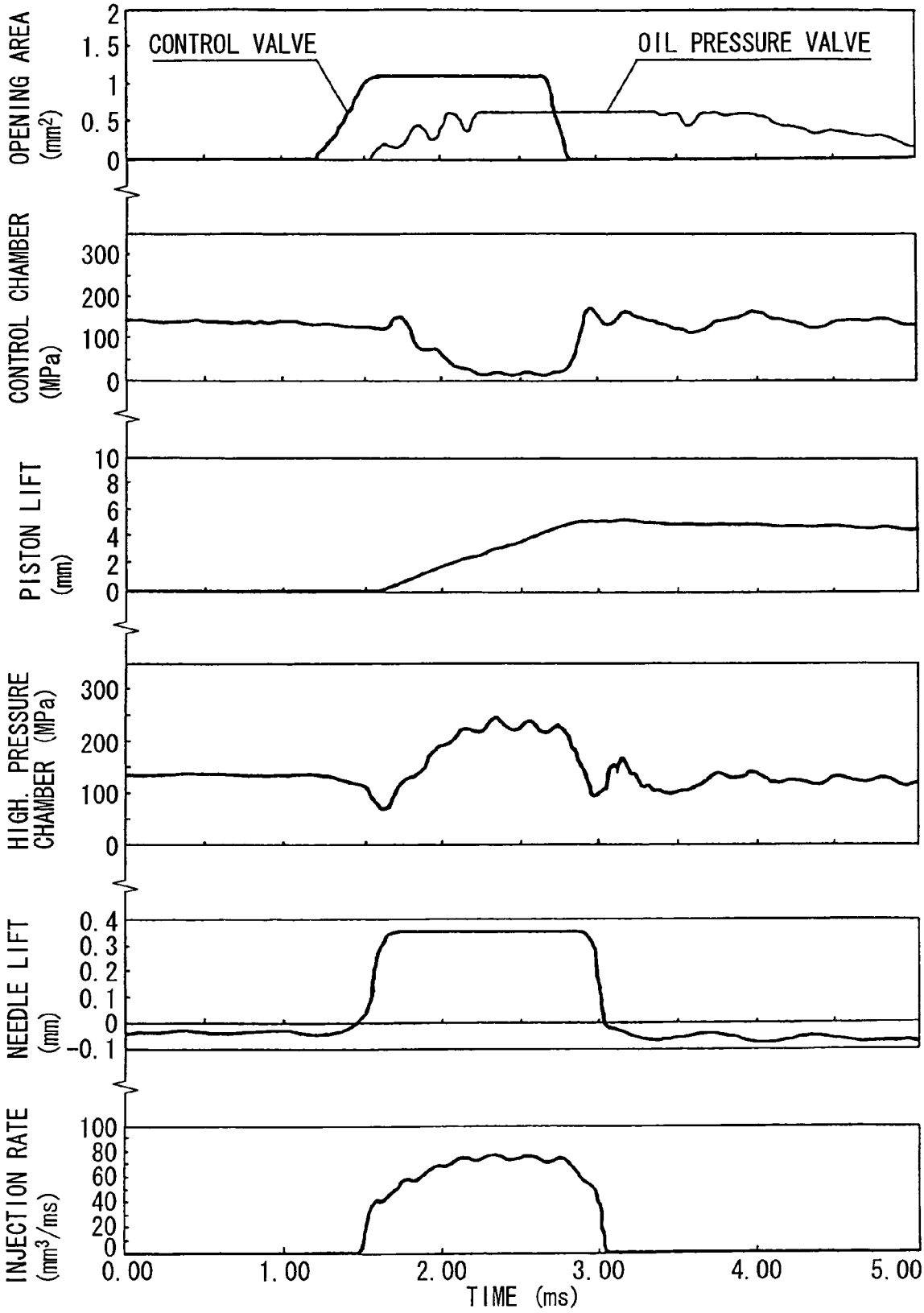
FIG. 7 is a graph showing the results of numerical analysis by the simulation of the action of the fuel injection system according to a first embodiment.

The results of numerical analysis by simulation are shown in FIG. 7. However, these are results when the cross-sectional area ratio of the hydraulic piston 8 is 2:1. According to this simulation, it is clear that the nearly same action and performance as has been described above can be obtained.

Here, while the one fuel passage 15 is provided with the check valve 17 in this first embodiment, a hydraulic valve can be provided in place of this check valve 17. Moreover, while the other fuel passage 16 is provided with the restrictor 19, the one fuel passage 15 may be provided with the restrictor 19 and both fuel passages 15, 16 may be provided with restrictors 19, respectively. Moreover, by substituting passage resistance for the restrictor 19, the restrictor 19 can be removed.

(Effect of First Embodiment)

In the fuel injection system 1 shown in the first embodiment, the control valve 5 is constructed as the two-position three-way valve. Hence, a hydraulic pressure supply passage for supplying the fuel pressure in the accumulator 2 to the control chamber 11 of the pressure intensifier 3 and the backpressure chamber 26 of the injection nozzle 4 and a hydraulic pressure supply passage for releasing the fuel pressure in the control chamber 11 and the backpressure chamber 26 to the low pressure side can be selectively opened or closed by one control valve 5. Moreover, the switching port 5*e* of the control valve 5 is connected in parallel with the control chamber 11 of the pressure intensifier 3 by two fuel passages 15, 16 and one fuel passage 15 is provided with the check valve 17 to allow the fuel to flow from the control valve 5 to the control chamber 11, whereas the other fuel passage 16 is provided with the hydraulic valve 18 to allow the fuel to flow from the control chamber 11 to the control valve 5.

With this, the control valve 5 and the control chamber 11 are connected with each other by two fuel passages (one fuel passage 15 and the other fuel passage 16), each of which has the direction of flow of the fuel controlled, and hence the action of the injection nozzle 4 and the action of the pressure intensifier 3 can be optimized. That is, at the initial stage of injection, by bringing the hydraulic valve 18 to a closed state, injection characteristics can be set by the control valve 5 and the restrictor 30 provided in the fuel passage 31 irrespective of the two fuel passages 15, 16. Further, in the latter half of injection, by bringing the hydraulic valve 18 to an open state, injection characteristics can be set by the restrictor 19. Still further, in the return stroke of the pressure intensifier 3, by bringing the hydraulic valve 18 to a closed state, characteristics when the injection nozzle 4 is closed can be set by the control valve 5 and the restrictor 30 and the return characteristics of the pressure intensifier 3 can be set by the check valve 17 and a restrictor (not shown) provided in one fuel passage 15.

As the results described above, the fuel pressure can be reduced at the initial stage of injection and the period during which fuel pressure is reduced can be changed by the set pressure of the hydraulic valve 18 and further, in the fine injection that does not require an extremely high pressure, time required for the fuel to be brought to the state of injection is extremely short and hence the fuel can be injected as it is held not pressurized. The period of this time can be further elongated by adding a restrictor 18*f* shown in FIG. 1 and can be easily set.

Moreover, the passage (one passage 15) for supplying the fuel pressure in the accumulator 2 to the control chamber 11 of the pressure intensifier 3 and the passage (other passage 16) for releasing the fuel pressure in the control chamber 11 to the low pressure side are provided separately. Hence, for example, as shown in by a graph shown by a broken line in FIG. 6E, the action characteristics of the pressure intensifier 3 can be arbitrarily changed and an injection rate pattern can be changed as shown by a graph shown by a broken line in FIG. 6F according to the action characteristics.

Moreover, in the hydraulic circuit described in the first embodiment, the fuel is not flowed freely except for a small amount of switching leak developed when the control valve 5 is switched, so that an energy loss can be suppressed and hence the fuel consumption of the internal combustion engine can be prevented from being reduced. Further, since the pressure intensifying stroke can be finished at the same time when the injection is finished, the pressure intensifier 3 is not required to be operated uselessly and hence the waste of driving energy can be eliminated.

According to the fuel injection system 1 of the present embodiment, by a simple construction of only using one control valve 5 driven by the two-position actuator 33, the injection of extremely high pressure and of little energy loss can be realized and the various injection patterns such as a low pressure pattern and an extremely high pressure pattern can be realized. Moreover, the action of the pressure intensifier 3 can be optimized and hence the optimum injection characteristics can be realized and the return time can be optimized.

[Second Embodiment]

Figure 8:
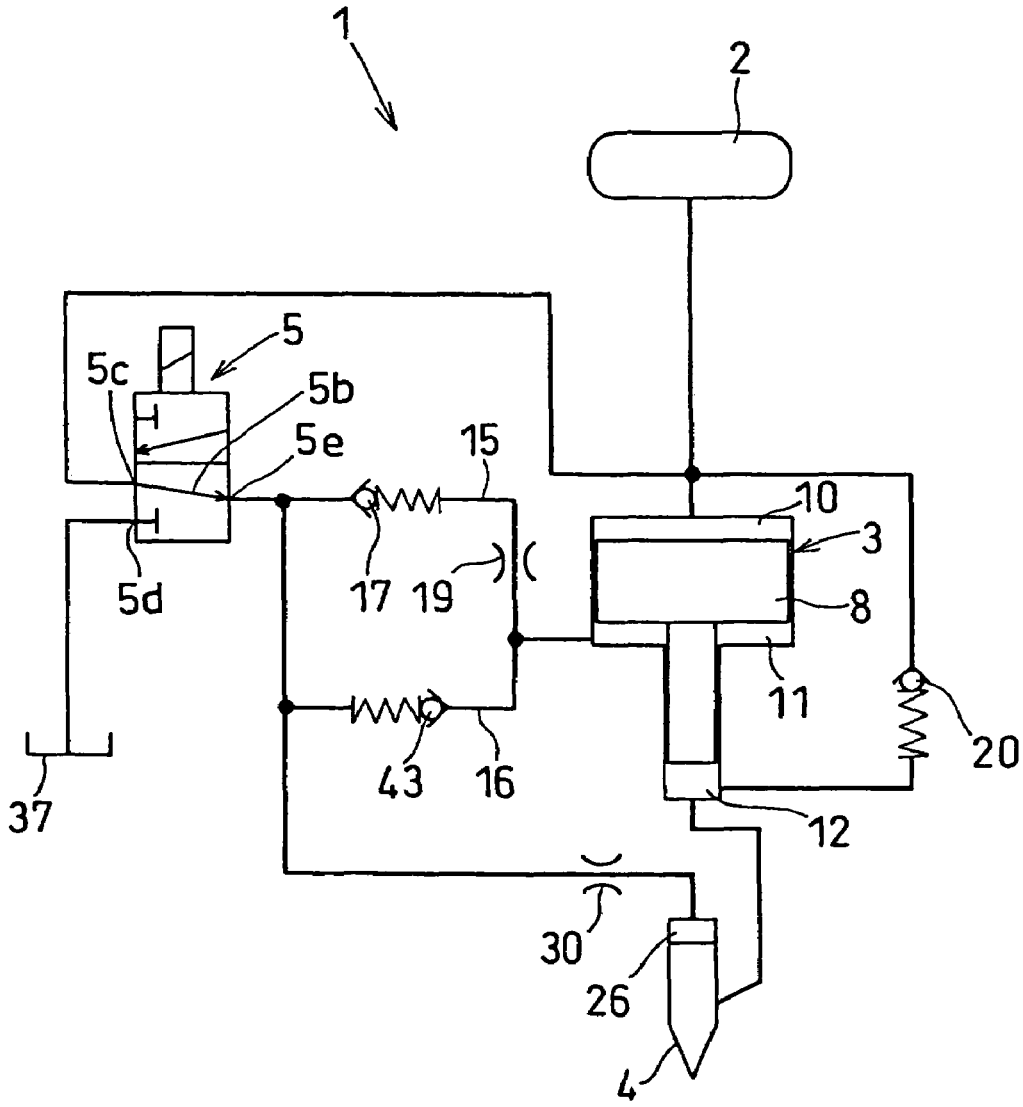
FIG. 8 is a hydraulic circuit diagram of a fuel injection system according to a second embodiment.

FIG. 8 is the hydraulic circuit diagram of the fuel injection system 1 in accordance with the second embodiment.

The configuration of the fuel injection system 1 shown in this second embodiment is different from the configuration of the first embodiment in that the other fuel passage 16 for connecting the switching port 5*e* of the control valve 5 with the control chamber 11 of the pressure intensifier 3 is provided with a check valve 43. In other words, in the first embodiment, the other fuel passage 16 is provided with the hydraulic valve 18, but in this second embodiment, the check valve 43 is provided in place of the hydraulic valve 18. Moreover, while the one fuel passage 15 is provided with the restrictor 19 in FIG. 8, as is the case with the first embodiment, the other fuel passage 16 may be provided with the restrictor 19 or both of the fuel passages 15, 16 may be provided with the restrictors 19, respectively.

Also in this second embodiment, a passage (one fuel passage 15) for supplying the fuel pressure in the accumulator 2 to the control chamber 11 of the pressure intensifier 3 and a passage (other fuel passage 16) for releasing the fuel pressure in the control chamber 11 to the low pressure side can be provided independently of each other and hence the action of the pressure intensifier 3 can be optimized and the optimum injection characteristics can be realized.

Moreover, as is the case with the first embodiment, a two-position three-way valve is used as the control valve 5, so that it is also possible to produce an effect of preventing the fuel from flowing freely except for a switching leak.

[Third Embodiment]

Figure 9:
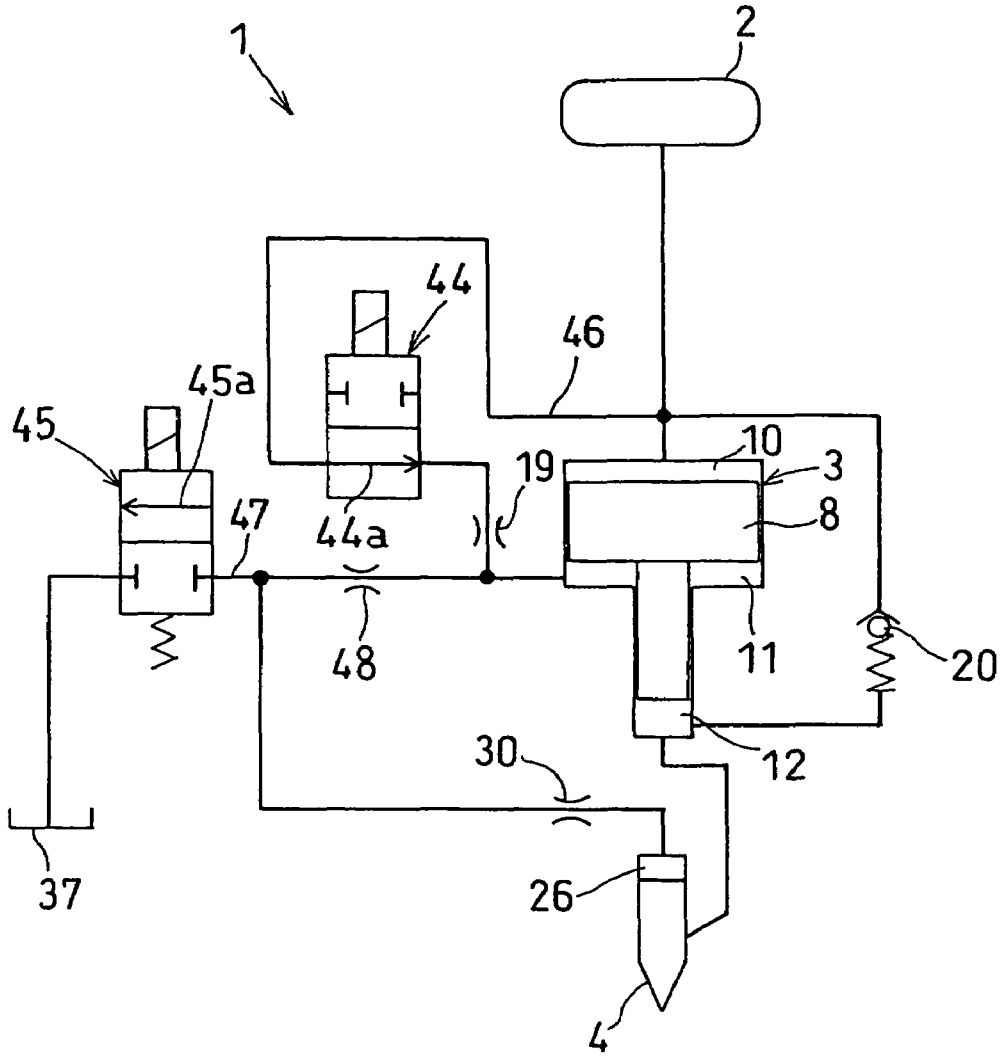
FIG. 9 is a hydraulic circuit diagram of a fuel injection system according to a third embodiment.
Figure 10:
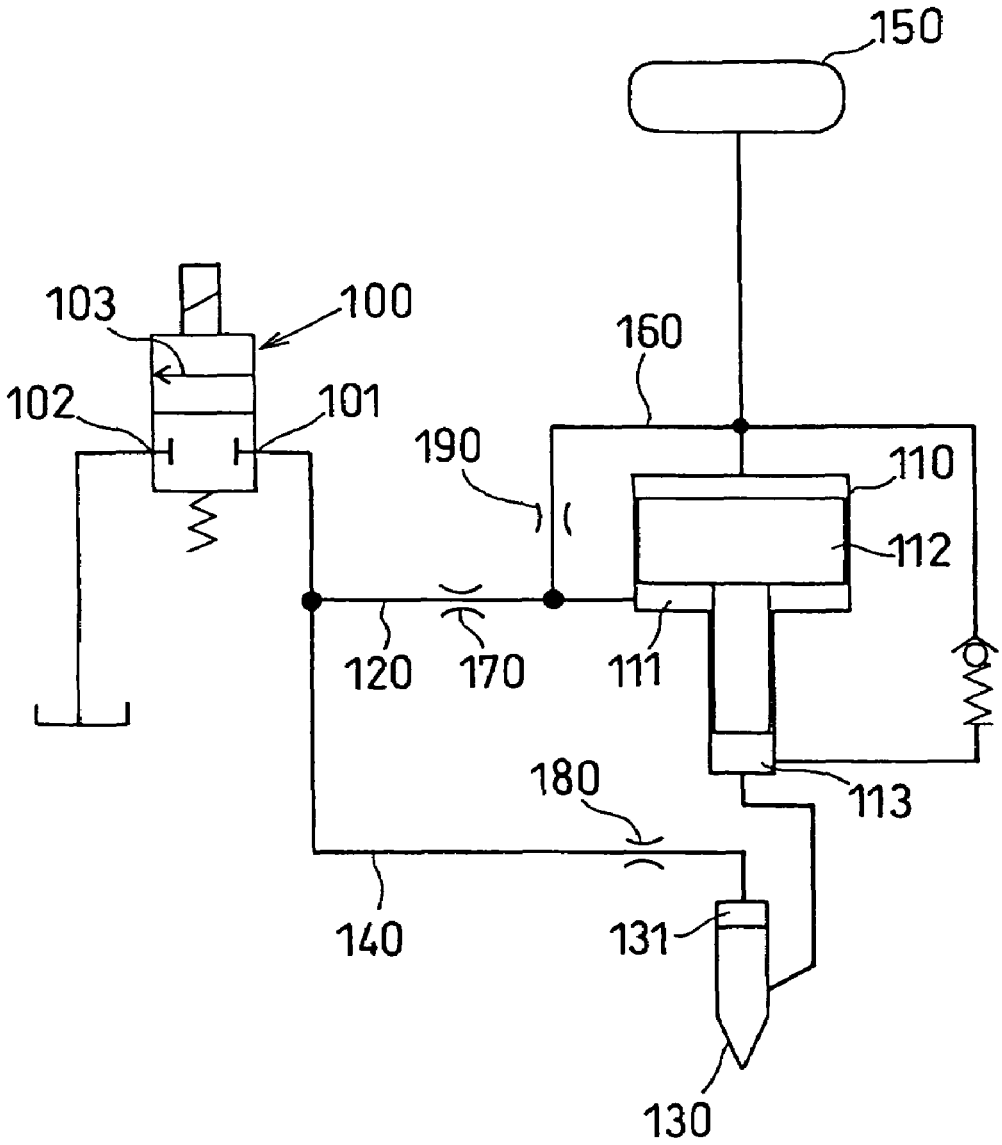
FIG. 10 PRIOR ART
FIG. 10 is a hydraulic circuit diagram of a conventional fuel injection system.

FIG. 9 is the hydraulic circuit diagram of the fuel injection system 1 in accordance with the third embodiment.

The fuel injection system 1 shown in this third embodiment is an example in which the action of the pressure intensifier 3 and the action of the injection nozzle 4 are controlled by two control valves (the first control valve 4 and the second control valve 45).

The two control valves are the first control valve 44 provided in a hydraulic pressure supply passage 46 for supplying the fuel pressure in the accumulator 2 to the control chamber 11 of the pressure intensifier 3 and the backpressure chamber 26 of the injection nozzle 4 and the second control valve 45 provided in a hydraulic pressure release passage 47 for releasing the fuel pressure in the control chamber 11 and the backpressure chamber 26 to the low pressure side.

The first control valve 44 has a valve body 44*a* driven by a two-position actuator and this valve body 44*a* is a two-position two-way valve capable of moving between a valve closing position where the hydraulic pressure supply passage 46 is closed and a valve opening position (position shown in FIG. 9) where the hydraulic pressure supply passage 46 is opened.

The second control valve 45 has a valve body 45*a* driven by a two-position actuator and this valve body 45*a* is a two-position two-way valve capable of moving between a valve closing position (position shown in FIG. 9) where the hydraulic pressure release passage 47 is closed and a valve opening position where the hydraulic pressure release passage 47 is opened.

Here, the first control valve 44 and the second control valve 45 are controlled in such a way that both of them are not brought to the valve opening state.

According to the configuration of this third embodiment, the hydraulic pressure supply passage 46 and the hydraulic pressure release passage 47 can be opened or closed independently of each other by the first control valve 44 and the second control valve 45, so that the action of the pressure intensifier 3 can be optimized and hence the optimum injection characteristics can be realized. That is, the backpressure of the nozzle, that is, the control of injection and the pressure intensifying action of the pressure intensifier 3 can be adjusted by two restrictors 48, 30. Further, the return stroke of the pressure intensifier 3 is adjusted by the restrictor 19 functioning when only the first control valve 44 is opened. The control of injection and the pressure intensifying action of the pressure intensifier 3, which can be adjusted by the two restrictors 48, 30, are important characteristics for determining the injection itself and the injection pressure. Still further, the control of the return stroke of the pressure intensifier 3 performed by the restrictor 19 is important characteristics for returning the pressure intensifier 3 to an original state before the next injection particularly in a high-speed internal combustion engine.

Moreover, since the first control valve 44 and the second control valve 45 are controlled in such a way that neither of them is brought to a valve opening state, it is possible to completely prevent the fuel from flowing freely from the accumulator 2 and hence to realize a hydraulic circuit free from an energy loss.

What is claimed is:

1. A fuel injection system for an internal combustion engine comprising:

an accumulator accumulating fuel in a state of a predetermined pressure;

a pressure intensifier having a control chamber of which hydraulic pressure is increased or decreased when the fuel flows into or flows out and a hydraulic piston moving according to an increase or a decrease in the hydraulic pressure in the control chamber, the pressure intensifier intensifying a pressure of the fuel to be supplied from the accumulator by a pressure intensifying action of the hydraulic piston;

an injection nozzle having a backpressure chamber of which hydraulic pressure is increased or decreased when the fuel flows into or flows out and a needle moving according to an increase or a decrease in the hydraulic pressure in the backpressure chamber, the injection nozzle injecting the fuel supplied by the accumulator or the fuel having pressure intensified by the pressure intensifier with a valve opening action by the needle;

a hydraulic pressure supply passage supplying fuel pressure in the accumulator to the control chamber and the backpressure chamber;

a hydraulic pressure release passage releasing fuel pressure in the control chamber and the backpressure chamber to a low pressure side; and a control valve provided in common in the hydraulic pressure supply passage and the hydraulic pressure release passage, and having a valve body driven by a two-position actuator and selectively opens and closes the hydraulic pressure supply passage and the hydraulic pressure release passage by the valve body to control an action of the pressure intensifier and an action of the injection nozzle, wherein the fuel injection system has two fuel passages, that are separate and distinct at least in part, that connect the control valve with the control chamber in parallel, one said fuel passage forming a portion of the hydraulic pressure supply passage and being provided with a first flow direction control means for preventing the fuel from flowing from the control chamber to the control valve, the other said fuel passage forming a portion of the hydraulic pressure release passage and being provided with a second flow direction control means for preventing the fuel from flowing from the control valve to the control chamber.

2. The fuel injection system for an internal combustion engine according to claim 1, wherein the second flow direction control means closes the other fuel passage until the fuel pressure in the backpressure chamber is decreased to a predetermined value when the control valve closes the hydraulic pressure supply passage and opens the hydraulic pressure release passage.

3. The fuel injection system for an internal combustion engine according to claim 2, wherein a predetermined value of pressure of the second flow direction control means is set according to a time delay that develops after injection starts and before the fuel pressure is intensified.

4. The fuel injection system for an internal combustion engine according to claim 1, wherein the control valve is a two-position three-way valve that has a switching port connected to the control chamber and the backpressure chamber through the two fuel passages, an input port connected to the accumulator, and a low pressure port communicating with a low pressure side and is driven between an input position where the valve body disconnects the low pressure port from the switching port and connects the input port to the switching port and an open position where the valve body disconnects the input port from the switching port and connects the low pressure port to the switching port.

5. The fuel injection system for an internal combustion engine according to claim 4, wherein the two fuel passages connect the switching port of the control valve to the control chamber of the pressure intensifier in parallel.

6. The fuel injection system for an internal combustion engine according to claim 5, wherein one ends of the two fuel passages are respectively connected in common to the switching port of the control valve and other ends of them are respectively connected in common to the control chamber of the pressure intensifier.

7. The fuel injection system for an internal combustion engine according to claim 1, wherein the first flow direction control means is a hydraulic valve or a check valve and wherein the second flow direction control means is a check valve or a hydraulic valve.

8. The fuel injection system for an internal combustion engine according to claim 1, wherein both of the first flow direction control means and the second flow direction control means are check valves.

9. The fuel injection system for an internal combustion engine according to claim 1, wherein both of the first flow direction control means and the second flow direction control means are hydraulic valves.

10. The fuel injection system for an internal combustion engine according to claim 7, wherein the hydraulic valve is a two-position two-way valve.

11. The fuel injection system for an internal combustion engine according to claim 7, wherein the hydraulic valve is activated by a pressure difference between the fuel pressure in the backpressure chamber of the injection nozzle or in the switching port of the control valve and the fuel pressure in the accumulator.

12. The fuel injection system for an internal combustion engine according to claim 1, wherein the one fuel passage, the other fuel passage, or each of both of the fuel passages is provided with a restrictor for setting action characteristics of the pressure intensifier.

13. The fuel injection system for an internal combustion engine according to claim 1, wherein the hydraulic piston moves to intensify the pressure of the fuel supplied from the accumulator when the fuel flows out from the control chamber.

14. A fuel injection system for an internal combustion engine, the fuel injection system comprising:

an accumulator accumulating fuel in a state of a predetermined pressure;

a pressure intensifier having a control chamber of which hydraulic pressure is increased or decreased when the fuel flows into or flows out and a hydraulic piston moving according to an increase or a decrease in the hydraulic pressure in the control chamber, the pressure intensifier intensifying pressure of the fuel to be supplied from the accumulator by a pressure intensifying action of the hydraulic piston;

an injection nozzle having a backpressure chamber of which hydraulic pressure is increased or decreased when the fuel flows into or flows out and a needle moving according to an increase or a decrease in the hydraulic pressure in the backpressure chamber, the injection nozzle injecting the fuel supplied by the accumulator or the fuel having pressure intensified by the pressure intensifier with a valve opening action by the needle;

a hydraulic pressure supply passage supplying fuel pressure in the accumulator to the control chamber and the backpressure chamber;

a hydraulic pressure release passage releasing fuel pressure in the control chamber and the backpressure chamber to a low pressure side;

a first control valve provided in the hydraulic pressure supply passage and having a valve body driven by a two-position actuator, the first control valve opening or closing the hydraulic pressure supply passage by the valve body; and a second control valve provided in the hydraulic pressure release passage and having a valve body driven by a two-position actuator, the second control valve opening or closing the hydraulic pressure release passage by the valve body, wherein the first control valve and the second control valve control an action of the pressure intensifier and an action of the injection nozzle, and wherein the hydraulic pressure supply passage and the hydraulic pressure release passage are formed at least in part as separate and distinct passages between the control valve thereof and the control chamber.

15. The fuel injection system for an internal combustion engine according to claim 14, wherein the first control valve is a two-position two-way valve driven between a valve closing position where the valve body closes the hydraulic pressure supply passage and a valve opening position where the valve body opens the hydraulic pressure supply passage, and wherein the second control valve is a two-position two-way valve driven between a valve closing position where the valve body closes the hydraulic pressure release passage and a valve opening position where the valve body opens the hydraulic pressure release passage.

16. The fuel injection system for an internal combustion engine according to claim 14, wherein in the first control valve and the second control valve, the valve body of the second control valve is driven to the valve closing position at least during an interval that the valve body of the first control valve is driven to the valve opening position and the valve body of the first control valve is driven to the valve closing position at least during an interval that the valve body of the second control valve is driven to the valve opening position.

17. The fuel injection system for an internal combustion engine according to claim 14, wherein the hydraulic pressure supply passage, the hydraulic pressure release passage, or each of both of the hydraulic pressure supply passage and the hydraulic pressure release passage is provided with a restrictor for setting action characteristics of the pressure intensifier.

* * * * *